United States Patent [19]

Perantoni et al.

[11] 3,979,542

[45] Sept. 7, 1976

[54] DECORATIVE PORCELAIN ENAMEL SURFACE AND METHOD FOR MAKING

[75] Inventors: John C. Perantoni; Myron E. Ullman, Jr., both of Canfield, Ohio

[73] Assignee: American Standard, Inc., New York, N.Y.

[22] Filed: Sept. 26, 1974

[21] Appl. No.: 509,324

[52] U.S. Cl. ..... 428/204; 264/73; 427/279; 427/281; 428/207; 428/450; 428/472

[51] Int. Cl.[2] ..... B32B 15/04; B28B 21/44

[58] Field of Search ..... 427/281, 279; 264/73, 264/74; 428/15, 30, 204, 207, 209, 212, 433, 450, 469, 472

[56] References Cited

UNITED STATES PATENTS

| | | | |
|---|---|---|---|
| 283,861 | 8/1883 | Cogswell | 427/281 X |
| 704,621 | 7/1902 | Czermak | 264/73 X |
| 1,485,810 | 3/1924 | Parker et al. | 264/74 X |
| 2,002,848 | 5/1935 | Cohen | 427/281 X |
| 2,039,548 | 5/1936 | Moore | 427/279 X |
| 2,071,765 | 2/1937 | Rodman | 427/279 X |
| 2,210,556 | 8/1940 | Rosenberg | 427/279 X |
| 2,226,913 | 12/1940 | Schlegel | 427/279 X |
| 3,340,087 | 9/1967 | Mazzola | 427/281 |
| 3,515,619 | 6/1970 | Barnette | 428/15 |

FOREIGN PATENTS OR APPLICATIONS

| | | |
|---|---|---|
| 477,632 | 1/1953 | Italy |
| 480,809 | 5/1953 | Italy |

*Primary Examiner*—Harold Ansher
*Attorney, Agent, or Firm*—James J. Salerno, Jr.; Robert G. Crooks; Tennes I. Erstad

[57] ABSTRACT

A decorative porcelain enamel surface, preferably having the appearance of marble, is produced by first preparing the surface of an article, which may be irregular in configuration, for receiving a finished coat of porcelain enamel. A finished coat of porcelain enamel is applied on the prepared surface, and then by any of several novel steps the enamel is variegated to produce a marble appearance.

1 Claim, 2 Drawing Figures

DECORATIVE PROCELAIN ENAMEL SURFACE AND METHOD FOR MAKING

BACKGROUND OF THE INVENTION

This application pertains to the art of decorative coatings and more particularly to decorative porcelain enamel coatings. The invention is especially applicable to the art of making marblelized porcelain enamel coatings and will be described with particular reference thereto. However, it will be appreciated that the invention has broader aspects and may be used for producing decorative porcelain enamel coatings in other than marblelized patterns.

There are many known procedures for producing various decorative effects on porcelain enamel surfaces. In a brushing process dried but unfired porcelain enamel is removed from the surface of the article by brushing or wiping to produce a pattern. The porcelain enamel is then fired and the porcelain surface is provided with a decorative pattern where the enamel was removed. In the so called screening process, an enamel paste is forced through a silk or metal form which is covered by a stencil made from oil paper or light sensitive gelatin. A decaling process is known in which previously prepared ceramic decals are fired onto the porcelain surface of the article. A printing process is also known in which rubber stamps or rollers are used for applying ink or colored oxides to adhesive varnish on the porcelain surface. There is also a graining and marblelizing process in which a previously prepared printing roll is inked and the ink is transferred to the porcelain surface. However, with all of these prior art rolling processes best results are obtained on flat or nearly flat surfaces.

It is a principle object therefore, of the present invention to provide an improved porcelain enamel surface and a novel method for producing the same.

It is an additional object of the present invention to provide a marblelized porcelain enamel surface and method for producing the same.

A further object of the present invention is to provide a marblelized porcelain enamel surface and method of making the same in an economical and commercially efficient manner.

A still further object of the present invention is to provide marblelized products having irregular porcelain enamel surfaces and methods for making the same.

BRIEF DESCRIPTION OF THE DRAWINGS

The invention may take form in certain preferred embodiments which will be described in detail in this specification and illustrated in the accompanying drawings, wherein.

DESCRIPTION OF THE PREFERRED EMBODIMENTS

In accordance with the present invention, an improved type of decorative pattern is formed in a porcelain enamel surface. The decorative pattern may be produced on any articles which are conventionally coated with porcelain enamel. Such articles include, but are not limited to, metal panels or sheets, sinks, tubs, metal drain boards, cabinets, countertops, stoves, washers and other housings for both domestic and commercial use.

A porcelain enamel finish is produced which, in its preferred embodiment has the appearance of genuine marble. A ground coat of porcelain enamel is first applied to the surface of an article by dipping, flooding or spraying a slurry thereon. The article is then heated to the fusing temperature of the porcelain enamel for fusing the ground coat to the surface of the article.

The application of a finish coat of a different color or shade to the surface of the ground coat, to achieve an appearance resembling marble, is performed by employing any one or any combination of several processes.

Figure 1:
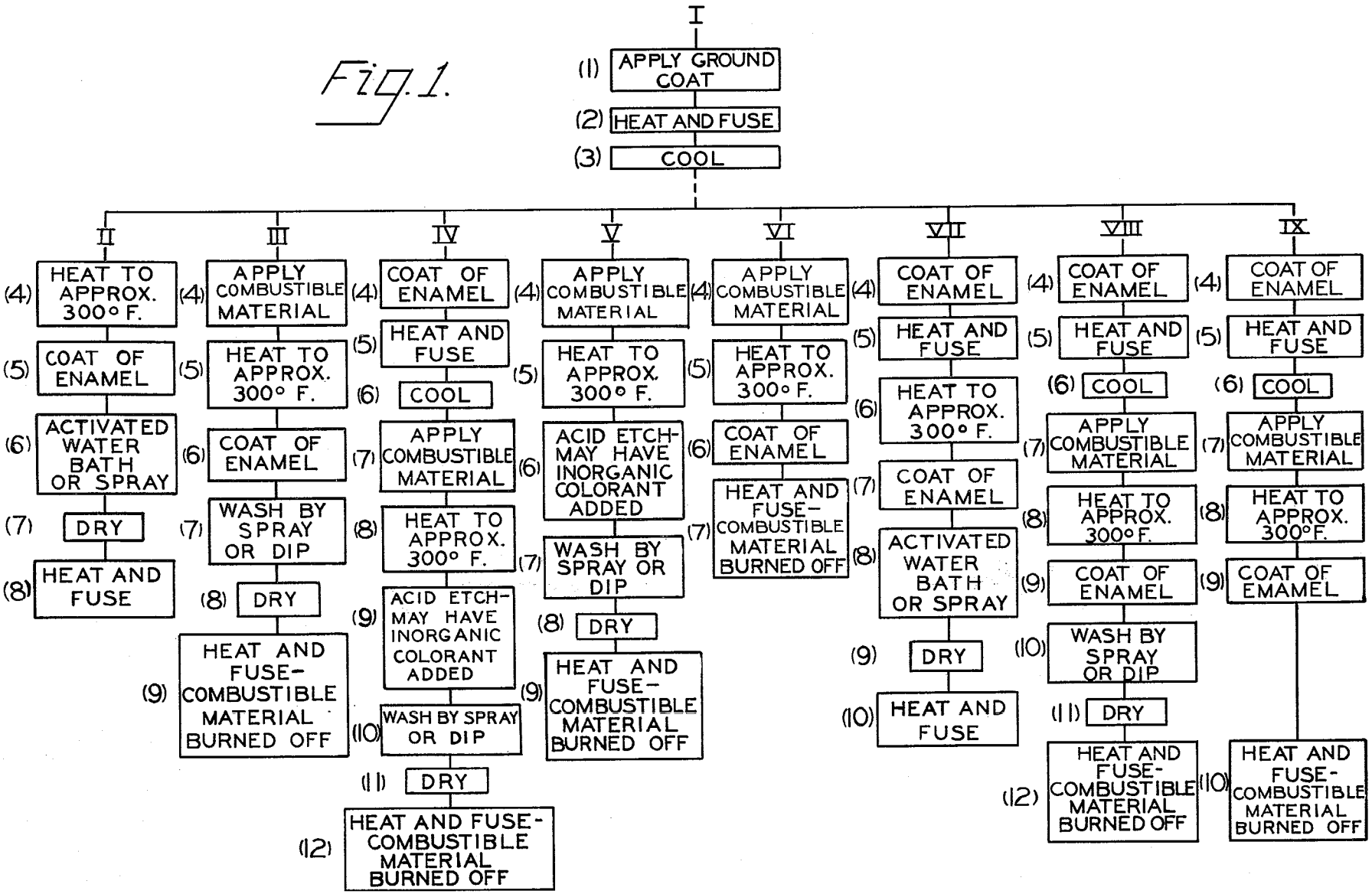
FIG. 1 is a flow chart showing procedures for producing a decorative porcelain enamel finish in accordance with the present invention.

Referring now to the FIG. 1 flow chart, after the primary common steps I are taken comprising applying a ground coat (1), heating and fusing (2) and cooling (3), sub-process II provides that the workpiece be heated to a temperature of around 300° F. (4) following which a very thin coating of one or more colors is applied to the ground coat (5). The water carrier is rapidly evaporated from this thin coat due to the elevated temperature of the workpiece. The workpiece is then dipped into a water bath in which waves are mechanically generated (6). See FIG. 2. The waves are permitted to lap against the surface of the workpiece and redistribute the bisque coating in a random pattern depositing the porcelain enamel in layers of varying thicknesses. Thereafter the workpiece is dried (7) and then re-heated to fuse the final pattern (8).

Sub-process III is performed by applying a sticky combustible material which will adhere to the surface of the workpiece (4). Such combustible material is one which will dry or solidify to at least a semi-solid state so that it will not flow or run when the workpiece is handled. This material is applied to the surface of the workpiece in a random decorative pattern and then heated to an elevated temperature (5) which is sufficient to evaporate the solvents in the sticky combustible material. A coating of porcelain enamel is then applied to the surface of the workpiece (6) while it is still hot, quickly evaporating the water in the enamel. A water spray is then applied to the surface of the workpiece (7). A portion of the enamel which is in contact with the surface washes away, while most of that which is in contact with the sticky combustible material remains during the wash. The article is then dried (8) and heated to the fusing temperature for fusing the porcelain enamel to the lower surface and causing the combustible material to burn off (9). As the material combusts, a portion of the porcelain enamel which is in contact with the combustible material is removed and a portion falls through the combustible material and is fused to the lower coat. The result is an uneven irregular pattern of the upper coat of porcelain enamel over the lower surface.

In a preferred arrangement combustible material comprises a rubber based adhesive having a solvent therein. One suitable type of such material is known as 3M Brand "Shipping Mate" case sealing adhesive, available from the 3M company of Minneapolis, Minn., or an equivalent. Such material includes styrene-butadiene rubber dissolved in a solvent such as hexane or methane which are aliphatic hydrocarbons. This material is sprayed through an atomizing nozzle under pressure in the form of discreet droplets toward the finish coat so that the material lands on the finish coat in a randomly distributed pattern of irregularly shaped globs and strings to give the appearance of veining in marble. It is recognized that other materials having this property may also be applied to the surface.

In accordance with this arrangement, the workpiece is then heated to a temperature between 300°F and 400°F. This will rapidly evaporate the solvents in the combustible material but will not cause combustion. While the workpiece is still hot, a thin layer of porcelain enamel having a color which is different than the ground coat is applied over the ground coat and the adhering combustible material. The water in the porcelain enamel evaporates. Moderate amounts of porcelain enamel cling to the ground coat. Most of the enamel which is applied to the combustible material remains. A light water spray is then directed against the surface of the workpiece washing some of the porcelain enamel away.

The workpiece is then heated to fuse the porcelain enamel to the finish coat. Concurrently, the combustible material burns away. Some of the enamel which had been applied to the combustible material falls away while some of it falls through the combustible material and fuses to the surface. The result is a decorative surface with an appearance like that of marble. Varying hues and shades appear due to the random distribution of the combustible material and because of the additional enamel over the ground coat.

Sub-process IV is performed by variegation of a finish coat which has already been fused to the surface of the workpiece. After coating, (4), fusing (5), and cooling (6), the same sticky combustible material as used in process III is applied to the surface in an irregular decorative pattern (7) and heated (8). The finish coat is then exposed to an acid (9), which partially dissolves the finish coat in areas not covered by the combustible material. The finish coat is then washed (10) to remove the acid, dried (11) and then heated to burn off the combustible material and re-fuse the finish coat (12). The thickness of the finish coat is reduced slightly in areas not covered by the combustible material because of the dissolving action of the acid, thus altering the shade of those areas. In the areas covered by the combustible material, the original color is not altered. The resulting surface has the appearance of at least two different colors with shades in between.

Sub-process IV may be modified to produce more variety of color and shade in the finished product. Thus, an inorganic colorant may be added to the acid to be applied to the surface of the workpiece. This will alter the color of the surface in areas which are not covered by the combustible material.

In accordance with this sub-process, the finish coat is exposed to hydrofluoric acid, either in gaseous form or as hydrofluoric acid solution. In a preferred arrangement the workpiece is dipped into a hydrofluoric acid bath for a length of time which varies according to the strength of the acid and the degree of dissolution desired in the finish coat.

The acid is then rinsed off by washing the surface with a water spray or by dipping the workpiece in to a water bath. The workpiece is then dried and heated to fuse the remaining enamel and to burn off the combustible material. In this arrangement the combustible material has acted as a mask to prevent the acid from etching the areas covered by the combustible material.

The above arrangement has been successfully employed to create a decorative surface by applying the above steps directly to the ground coat as diagrammed in sub-process V of FIG. 1.

A different decorative design may be obtained by following the method diagrammed in sub-process III of FIG. 1 with the elimination of the washing step, as diagrammed in sub-process VI. This method produces a surface similar to the method of sub-process III, but leaves more enamel in the areas not covered by the combustible material.

Many other modifications of these described sub-processes are possible, each yielding different results on the surface of the workpiece. For instances, sub-processes VII and VIII of FIG. 1 are variations of the methods diagrammed in sub-processes II and III respectively. These methods of sub-processes VIII and VIII add the additional steps of a primary finish coat applied over the ground coat and fused before the final finish coat is applied and variegated. Further variation of the arrangement diagrammed in sub-process VIII is found in sub-process IX of FIG. 1. This arrangement eliminates the washing-drying process just prior to heating to fuse the enamel and burn off the combustible material. The surface produced by using the method diagrammed in sub-process IX has more of the final finish color remaining in areas where the combustible material was not applied.

Although several different sub-processes have been described for producing marblelized effects, the procedure outlined in sub-process II of FIG. 1 is a particularly preferred embodiment because of its simplicity. However, it is recognized that the patterns of the other sub-processes may be preferred for aesthetic or commerical reasons. In any of the above procedures, it will be recognized that it is possible to apply a final thin coating of a clear porcelain enamel to seal and protect the decorative surface. If the final coat is sufficiently thick it will flood the low spots to render the product substantially smooth wherein the decorative pattern will show through the clear coating.

In each of the processes described, it will be recognized that an article is produced having a porcelain enamel finish with randomly distributed first areas of a first color being randomly distributed in a second area of a second color different from the first color. The described arrangement for applying an adhesive or combustible material produces a decorative finish which looks remarkably like marble.

Figure 2:
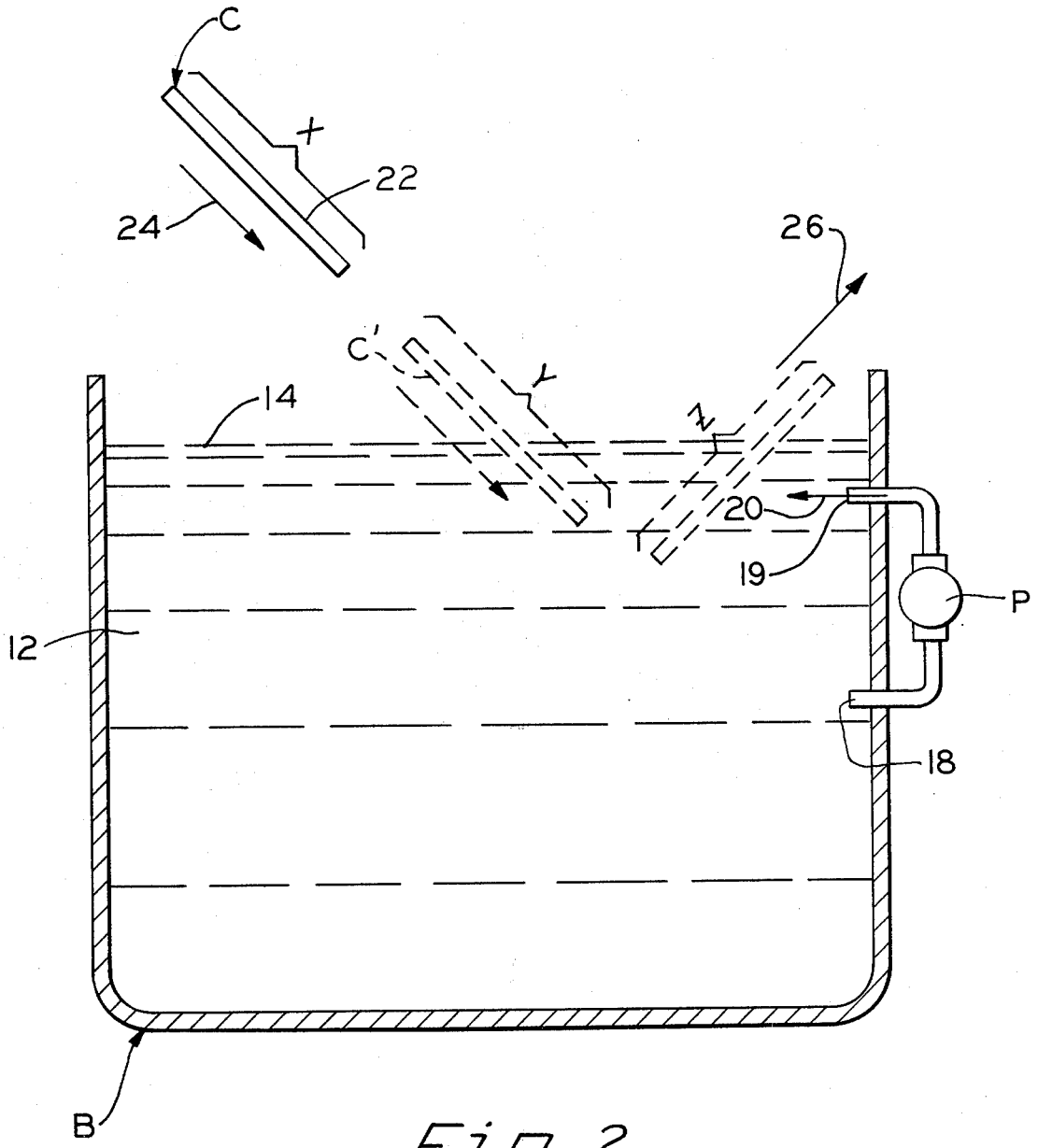
FIG. 2 is an elevational view in section showing an activated water bath.

FIG. 2 shows an elongated receptacle B filled with water 12 or other liquid. Water 12 has a free surface as at 14. A pump P has an inlet 18 communicating with a lower portion of the receptacle B and an outlet 19 communicating with the upper portion of the receptacle B beneath the free surface 14 of water 12. With pump P operating, water is discharged through outlet 19 in the direction of arrow 20. This produces waves traveling across surface 14 from right to left in FIG. 2. A workpiece C, at position X, having the described thin porcelain enamel coating on surface 22 thereof is moved into water 12 in the direction of arrow 24. As workpiece C begins to be submerged in water 12, at position Y as shown in phantom at C, the waves travelling across surface 14 lap against surface 22 of workpiece C for producing random patterns. The workpiece is removed from water 12 as shown at position Y and as indicated by arrow 26. Workpieces may also be hung on an overhead conveyor for movement through water 12 to produce the random pattern. It will be recognized that workpieces having surfaces of many different shapes and configurations can be produced with the method steps of the present invention, and it is possible to produce random patterns on curved or irregular surfaces, as well as on flat surfaces. Thereafter, the workpiece is finished in a manner previously described. Although the invention has been described with reference to certain preferred embodiments, it is obvious that equivalent alterations and modifications will occur to others skilled in the art upon the reading and understanding of this specification. The described invention is intended to include all such alterations and modifications and is limited only by the scope of the claims.

Having thus described our invention we claim:

1. An article having a decorative fused and vitrified porcelain enamel finish on a metal panel, said finish at least two layers comprising:

a ground coat consisting of porcelain enamel paste in water having a first color applied to said metal panel over the entire surface thereof and fused by heating to fusing temperature and a porcelain enamel finish coat fused to said ground coat of a different color than said first color and distributed on said ground coat in randomly spaced areas to provide a variegated pattern resembling marble, said finish coat consisting of porcelain enamel paste in water and inorganic colorant unevenly distributed after fusing to produce a fired finish coating having areas of differing thicknesses over said ground coat to thereby provide a variegated pattern of non-uniform thickness.

* * * * *